US012723362B2

(12) United States Patent
Liu et al.

(10) Patent No.: US 12,723,362 B2
(45) Date of Patent: Sep. 1, 2026

(54) WASTE COLLECTION APPARATUS

(71) Applicant: EVOLUTIVE LABS CO., LTD., Taipei City (TW)

(72) Inventors: Wei-Chun Liu, Taipei City (TW); Ching-Fu Wang, Taipei City (TW); Cheng-Che Ho, Taipei City (TW)

(73) Assignee: EVOLUTIVE LABS CO., LTD., Taipei City (TW)

( * ) Notice: Subject to any disclaimer, the term of this patent is extended or adjusted under 35 U.S.C. 154(b) by 560 days.

(21) Appl. No.: 18/152,246

(22) Filed: Jan. 10, 2023

(65) Prior Publication Data

US 2024/0084536 A1 Mar. 14, 2024

Related U.S. Application Data

(60) Provisional application No. 63/375,256, filed on Sep. 12, 2022.

(51) Int. Cl.
*E02B 15/10* (2006.01)

(52) U.S. Cl.
CPC ..... *E02B 15/106* (2013.01)

(58) Field of Classification Search
None
See application file for complete search history.

(56) References Cited

U.S. PATENT DOCUMENTS 3,656,624 A * 4/1972 Walton ..... E02B 15/046 210/523
4,322,294 A * 3/1982 Price ..... E02B 15/104 210/540
5,957,295 A * 9/1999 Neureither ..... B03B 5/32 241/24.1
6,027,641 A * 2/2000 Spradbury ..... B01D 29/90 210/167.2
6,199,502 B1 * 3/2001 Mattson ..... E02B 3/064 114/267
6,202,675 B1 * 3/2001 Forte ..... E02D 29/14 137/371
6,761,124 B1 * 7/2004 Srinivasan ..... B63B 1/107 405/195.1

(Continued)

FOREIGN PATENT DOCUMENTS

CN 1565924 A 1/2005
CN 105235847 A 1/2016

(Continued)

OTHER PUBLICATIONS

Chinese language office action dated Jun. 5, 2024, issued in application No. TW 112125195.

(Continued)

*Primary Examiner* — Kayla Mccaffrey

(74) *Attorney, Agent, or Firm* — McClure, Qualey & Rodack, LLP

(57) ABSTRACT

A waste collection apparatus for collecting waste in water includes a floating device and a waste collection device coupled to the floating device. The floating device includes a plurality of floating units. The waste collection device is coupled to the floating device. Each of the floating units includes a base and a pillar connected to the base, and the density of the base is greater than the density of the pillar.

24 Claims, 14 Drawing Sheets

(56) References Cited

U.S. PATENT DOCUMENTS

| | | | | |
|---|---|---|---|---|
| 8,601,804 | B2 * | 12/2013 | Akashi | F03D 9/28 60/494 |
| 10,787,233 | B2 * | 9/2020 | Gatesoupe | F03D 13/25 |
| 2016/0075413 | A1 * | 3/2016 | Nebrera Garcia | E02D 27/425 114/122 |

FOREIGN PATENT DOCUMENTS

| | | | |
|---|---|---|---|
| CN | 107021190 | A | 8/2017 |
| CN | 209067404 | U | 7/2019 |
| CN | 111634378 | A | 9/2020 |
| CN | 112722172 | A | 4/2021 |
| CN | 112761127 | A | 5/2021 |
| CN | 213571864 | U | 6/2021 |
| CN | 113699955 | A | 11/2021 |
| CN | 114753335 | A | 7/2022 |
| DE | 20 2014 007 133 | U1 | 12/2015 |
| KR | 200255925 | Y1 | 12/2001 |
| KR | 20140017965 | A | 2/2014 |
| KR | 20150032442 | A | 3/2015 |
| KR | 102257043 | B1 | 5/2021 |
| TW | 202102745 | A | 1/2021 |
| WO | 2021/005843 | A1 | 1/2021 |

OTHER PUBLICATIONS

International Search Report and Written Opinion dated Jan. 31, 2024, issued in application No. PCT/SG2023/050485.

Extended European Search Report dated Dec. 7, 2023, issued in application No. EP 23156605.0.

Japanese language office action dated May 26, 2026, issued in application JP 2025-514872.

* cited by examiner

600

600

600

600

WASTE COLLECTION APPARATUS

CROSS REFERENCE TO RELATED APPLICATIONS

This application claims the benefit of U.S. Provisional Application No. 63/375,256, filed on Sep. 12, 2022, the entirety of which is incorporated by reference herein.

BACKGROUND OF THE INVENTION

Field of the Invention

The present disclosure relates to a waste collection apparatus for collecting waste in water.

Description of the Related Art

Tons of waste enters open water (including oceans, seas, lakes, rivers, etc.) every year. Waste accumulation may cause serious damage not only to the environment but also to animals' lives. Therefore, it's crucial to collect and remove waste from the water. A waste collection apparatus is provided.

BRIEF SUMMARY OF THE INVENTION

According to some embodiments of the present disclosure, a waste collection apparatus for collecting waste in water is provided. The waste collection apparatus includes a floating device including a plurality of floating units and a waste collection device coupled to the floating device. Each of the floating units includes a base and a pillar connected to the base, and the density of the base is greater than the density of the pillar.

In some embodiments, the center of gravity of each of the floating units is under a water level of the water. In some embodiments, the base and the pillar include steel, aluminum, steel reinforced concrete, reinforced concrete, fiber reinforced plastic, or a combination thereof. In some embodiments, the floating device further includes a waterproof element disposed at a connection part where the pillar and the base are connected. In some embodiments, the pillar is hollow, the base is solid, and the diameter of the base is greater than the diameter of the pillar. In some embodiments, the floating device further includes a counterweight disposed inside the pillar or on the base. In some embodiments, the floating device further includes a bulk element disposed inside the pillar, and the bulk element includes expanded polystyrene (EPS) or expanded polypropylene (EPP).

In some embodiments, the floating device further includes a frame connecting the floating units to each other. In some embodiments, the frame is a grid structure. In some embodiments, the waste collection apparatus further includes a power supply unit disposed in a hollow portion of the grid structure. In some embodiments, the frame includes metal. In some embodiments, the floating device further includes a plurality of fastening elements, and the frame is connected to the floating units via the fastening elements. In some embodiments, the frame is in contact with an upper surface of the pillar. In some embodiments, the floating device further includes a reinforcement frame, and the reinforcement frame is in contact with an outer surface of the pillar. In some embodiments, the waste collection apparatus further includes an anchor attached to the frame or at least one of the floating units.

In some embodiments, the waste collection apparatus further includes a construction built on the frame. In some embodiments, the density of the base is greater than the density of the construction. In some embodiments, the number of floating units is determined by dimensions and weight of the construction. In some embodiments, the waste collection apparatus further includes a suction pump, wherein a cooling system is provided on the construction, the suction pump lifts external water by suction and supplies the external water to the cooling system to lower temperature of the construction.

In some embodiments, the waste collection device includes a fluid ejection element, and the flow out of the fluid ejection element flows toward a space where waste is collected. In some embodiments, the fluid ejection element is a pipe. In some embodiments, the waste collection apparatus further includes a suction pump coupled to the floating device, wherein the suction pump lifts external water by suction and supplies the external water to the fluid ejection element. In some embodiments, the waste collection apparatus further includes a sensing device for sensing an amount of collected waste.

According to some embodiments of the present disclosure, a waste collection apparatus for collecting waste in water is provided. The waste collection apparatus includes a floating platform, a plurality of branching units connected to the floating platform, and a waste collection device disposed below the floating platform. Each of the branching units includes a column and a bottom plate connected to the column, and the density of the bottom plate is greater than the density of the column.

BRIEF DESCRIPTION OF THE DRAWINGS

The present disclosure can be more fully understood by reading the detailed description and examples with references made to the accompanying drawings. It should be noted that various features may be not drawn to scale. In fact, the dimensions of the various features may be arbitrarily increased or decreased for clarity of discussion, and the various features may be drawn schematically.

DETAILED DESCRIPTION OF THE INVENTION

The following description provides many different embodiments, or examples, for implementing different features of the present disclosure. Ordinal terms such as "first", "second", etc., used in the description and claims do not by themselves connote any priority, precedence, or order of one element over another, but are used merely as labels to distinguish one element from another element having the same name. Therefore, a first element in the description may be referred to as a second element in the claims. In addition, in different examples of this disclosure, similar and/or corresponding symbols may be used repeatedly. These similar and/or corresponding symbols or alphabets are used for the sake of clear description of some embodiments of the present application, and they do not dictate any relationship between different embodiments and/or structures.

Spatially relative terms, such as "above" and the like, may be used herein for ease of description to describe one element or feature's relationship to another element or feature as illustrated in figures. The spatially relative terms are intended to encompass different orientations of the device in use or operation in addition to the orientation depicted in the figures. The device may be otherwise oriented (rotated 90 degrees or at other orientations) and the spatially relative descriptors used herein may likewise be interpreted accordingly. If a device of the drawings is flipped upside down, an element that is "above" will become an element that is "below".

In this specification, the terms "including", "comprising", "having", and the like should be interpreted as meaning "including but not limited to . . . ". Therefore, when the terms "including", "comprising", "having", and the like are used in the description of this disclosure, the presence of corresponding features, regions, steps, operations and/or components is specified, and without excluding the presence of one or more other features, regions, steps, operations and/or components. In addition, deviation between any two numerical values or directions may exist.

Figure 1:
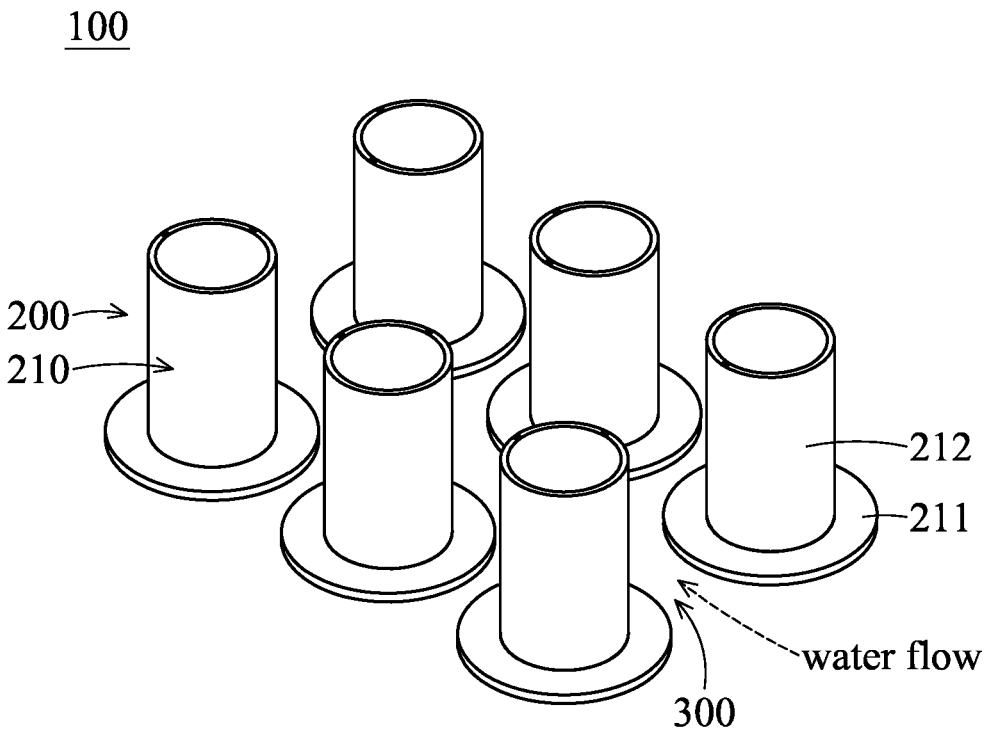
FIG. 1 illustrates a perspective view of a waste collection apparatus, in accordance with some embodiments.
Figure 2:
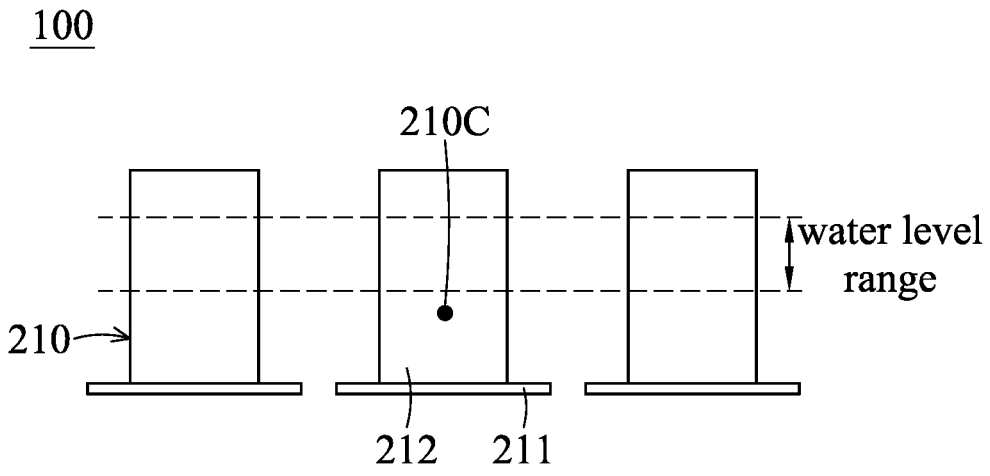
FIG. 2 illustrates a side view of the waste collection apparatus, in accordance with some embodiments.

A waste collection apparatus 100 which is adapted for floating on water is provided. The waste to be collected may include any garbage, refuse, or sludge. In addition, the waste to be collected may be solid waste, liquid waste, or semisolid waste, such as plastics or oil spills. Please refer to FIG. 1 and FIG. 2. The waste collection apparatus 100 includes a floating device 200 and a waste collection device 300 coupled to the floating device 200. The floating device 200 includes a plurality of floating units 210. Each of the floating units 210 includes a base 211 and a pillar 212 connected to the base 211. Furthermore, the pillar 212 is connected to an upper portion of the base 211, and the base 211 and part of the pillar 212 are under water level. In some embodiments, the waste collection device 300 represents the space formed between the floating units 210. The space may be used for collecting and accommodating waste. In some embodiments, the waste collection device 300 includes elements close to the floating units 210, and the elements may be specifically used for collecting and accommodating waste.

The waste collection apparatus 100 may bob up and down. To prevent the waste collection apparatus 100 from capsizing, the water level is designed to be within a certain range of the height of waste collection apparatus 100. To make sure the water level is within a certain range of the height of waste collection apparatus 100, the density of the base 211 is greater than the density of the pillar 212, so the center of gravity of the waste collection apparatus 100 is relatively low to ensure that the waste collection apparatus 100 is stable. For example, the center of gravity 210C of each of the floating units 210 may be under the water level most of the time.

Figure 3A:
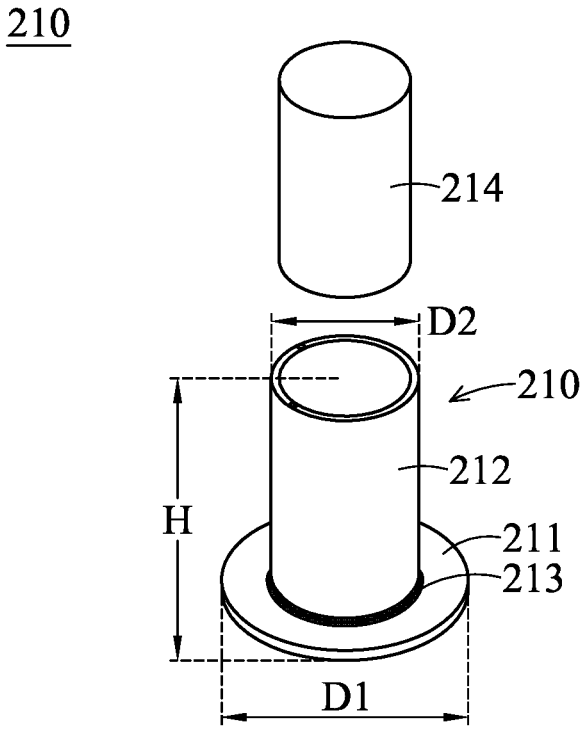
FIG. 3A and FIG. 3B illustrate perspective views of one of the floating units, in accordance with some embodiments.
Figure 3B:
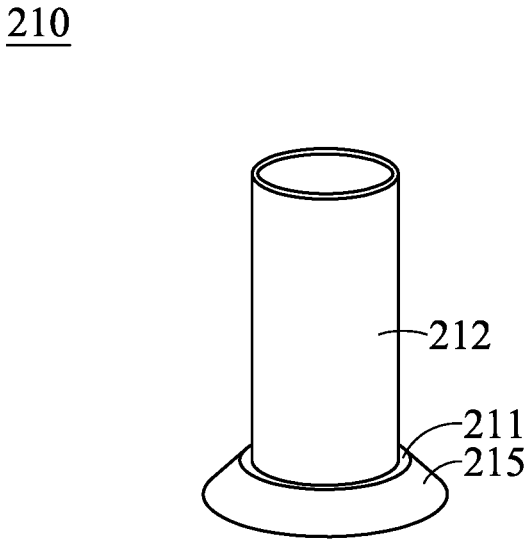

Next, please refer to FIG. 3A and FIG. 3B. In some embodiments, the base 211 and the pillar 212 may include steel, aluminum, concrete, reinforced concrete (RC), steel reinforced concrete, fiber reinforced plastic (FRP), or a combination thereof. In some embodiments, the base 211 and the pillar 212 are manufactured in the same processes and formed integrally. In some embodiments, the base 211 and the pillar 212 are manufactured separately and then be assembled together.

In some embodiments, the base 211 is solid, and the pillar 212 is hollow, so the density of the base 211 is greater than the density of the pillar 212 (due to the formula: $\rho=m/v$), but the structures of the base 211 and the pillar 212 are not limited thereto. In some embodiments, the base 211 may be a plate-like structure, and the pillar 212 may be a cylinder. In some embodiments, the base 211 is replaced as a metal chain fixed to the pillar 212. In some embodiments, the plate-like base 211 may include an inclined peripheral portion that extends downwardly. In some embodiments, the base 211 and/or the pillar 212 may include a balance element 215. The balance element 215 helps to keep the floating units 210 balanced in the water. In some embodiments, the balance element 215 may extend around the base 211 and/or the pillar 212. In some embodiments, the balance element 215 may be a fin. In some embodiments, the balance element 215 may be referred to as "a bilge keel."

In some embodiments, the diameter D1 of the base 211 is greater than the diameter D2 of the pillar 212. In some embodiments, the diameter D1 of the base 211 is about 5.0 m to about 7.0 m, such as 6.0 m. In some embodiments, the diameter D2 of the pillar 212 is about 3.0 m to about 5.0 m, such as 4.0 m. In some embodiments, the height H of each of the floating units 210 is about 6.0 m to about 9.0 m, such as 7.0 m, or 8.0 m. In some embodiments, the distance between adjacent bases 211 on the longer side of the waste collection apparatus 100 is between 0.5 m to 4.0 m, such as 1.0 m, 2.0 m, or 3.0 m. In some embodiments, the distance between adjacent bases 211 in on the shorter side of the waste collection apparatus 100 is between 1.0 m to 5.0 m, such as 2.0 m, or 4.0 m.

In some embodiments, the floating device 200 may include a waterproof element 213 disposed at a connection part where the pillar 212 and the base 211 are connected. The waterproof element 213 may include silicon. It should be noted that, in FIG. 3A, the waterproof element 213 is disposed on (e.g. by coating) the outer surface of the pillar 212, but the waterproof element 213 may also be disposed on the inner surface of the pillar 212. In some embodiments, the amount of the waterproof element 213 disposed on the outer surface of the pillar 212 is more than the amount of the waterproof element 213 disposed on the inner surface of the pillar 212. In some embodiments, the floating device 200 may include a bulk element 214 disposed inside the pillar 212. The bulk element 214 may include expanded polystyrene (EPS), expanded polypropylene (EPP), and the like. The density of the bulk element 214 may be relatively low, so that the weight of the overall floating units 210 does not change much. The volume of the bulk element 214 may be substantially the same as the volume of the interior of the pillar 212. The waterproof element 213 and the bulk element 214 are able to prevent water from entering the interior of the floating units 210. Therefore, the use life of the floating units 210 may be extended.

In some embodiments, there may be weight deviation between different floating units 210. Therefore, in some embodiments, the floating units 210 that are lighter than other floating units 210 may include a counterweight (not shown) disposed inside the pillar 212 or on the base 211. The counterweight may include concrete or metal. In embodiments in which the counterweight is made of concrete, the counterweight may be poured to the interior of the pillar 212 directly or formed as a single piece. In embodiments in which the counterweight is made of metal, the counterweight may be formed as a single piece. In some embodiments, the counterweight having a single-piece structure may be affixed to the pillar 212 or the base 211 by adhesive materials. In some embodiments, the counterweight having a single-piece structure may be disposed in a receiving portion (e.g. a groove or a recess) formed on the corresponding floating unit 210, for example, the receiving portion may be formed on the top surface of the base 211 or the interior of the pillar 212. The counterweight may enhance the stability of the waste collection apparatus 100.

Since each of the floating units 210 may be manufactured by the same processes, the stability of the waste collection apparatus 100 may be guaranteed through the standardization of manufacture of the floating units 210. In addition, manufacture cost may be reduced due to the standardization.

Different methods may be used to connect the floating units 210 to each other. Please refer to FIG. 4. In some embodiments, the floating device 200 may include a frame 220 and a plurality of fastening elements 230. The frame 220 and the fastening elements 230 may be used for connecting the floating units 210 to each other.

The frame 220 may include metal, such as aluminum or iron. The frame 220 may be formed by welding. For example, the frame 220 may be a skeleton frame, and different numbers of columns may be connected to each other by welding. The frame 220 may be treated to stop it from corroding. In some embodiments, the frame 220 is a grid structure with a plurality of hollow portions 221. In some embodiments, the hollow portions 221 may be filled with a material such as expanded polystyrene (EPS) or expanded polypropylene (EPP), so the frame 220 is cuboid-like. In some embodiments, some hollow portions 221 are filled with the material while the others are not.

In some embodiments, the waste collection apparatus 100 may include a power supply unit 400 for supplying power to the waste collection apparatus 100 or a construction 500 (which will be described below), and the power supply unit 400 may be disposed in one of the hollow portions 221 of the grid structure. For example, the power supply unit 400 may be a battery which can generate electricity and may be electrically connected to the floating units 210 to supply power to the waste collection apparatus 100 or the construction 500. Other elements may also be disposed in the hollow portions 221.

Figure 4:
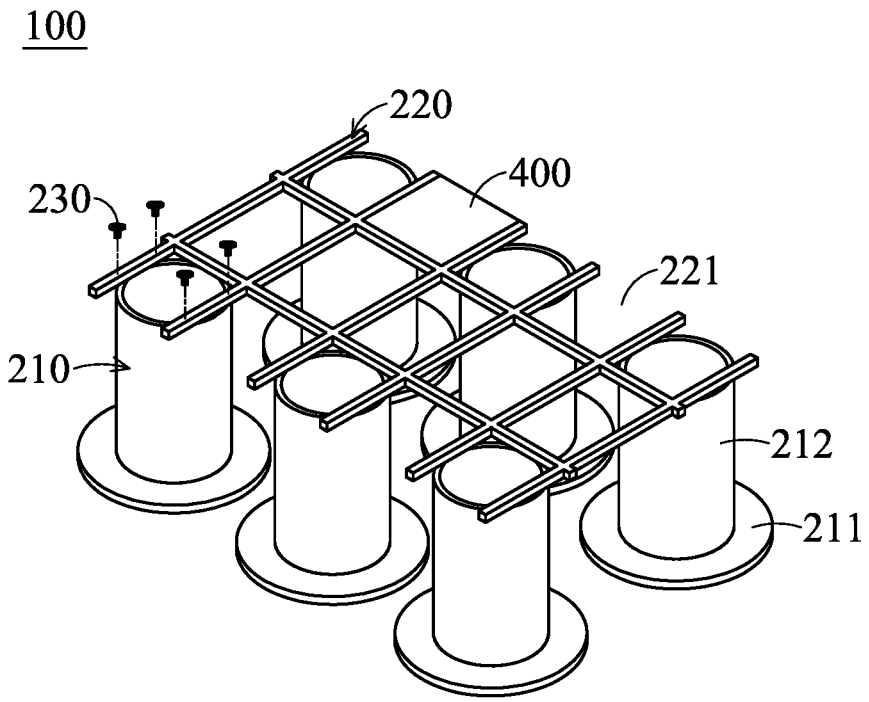
FIG. 4 illustrates a perspective view of the waste collection apparatus with a frame and a plurality of fastening elements, in accordance with some embodiments.

The fastening elements 230 may be bolts, screws, and the like. The frame 220 is connected to the floating units 210 via the fastening elements 230. In some embodiments, the frame 220 is in contact with the upper surface of the pillar 212. For ease of illustration, only some of the fastening elements 230 are illustrated in FIG. 4, but there may be other fastening elements 230 for the rest of the floating units 210.

Figure 5:
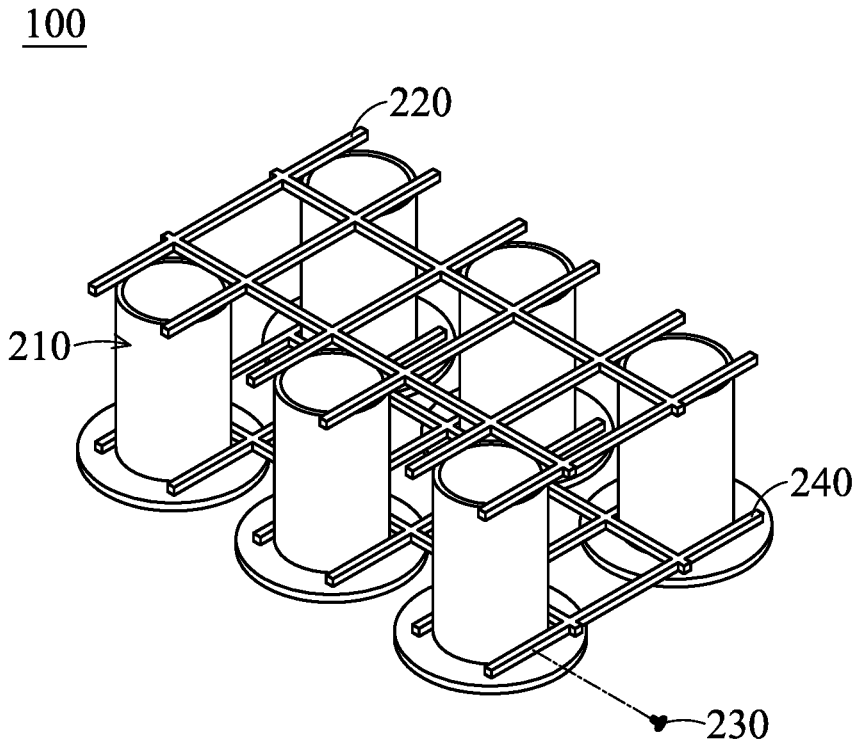
FIG. 5 illustrates a perspective view of the waste collection apparatus with a reinforcement frame, in accordance with some embodiments.

Next, please refer to FIG. 5. In addition to the frame 220, the floating device 200 may further include a reinforcement frame 240. The reinforcement frame 240 may include the same material as the frame 220. The reinforcement frame 240 may strengthen the connection between the floating units 210. In some embodiments, the reinforcement frame 240 is in contact with the outer surface of the pillar 212 and the top surface of the base 211 (as shown in FIG. 5). For ease of illustration, only one of the fastening elements 230 is illustrated in FIG. 5, but there may be other fastening elements 230 for the rest of the floating units 210.

Figure 6:
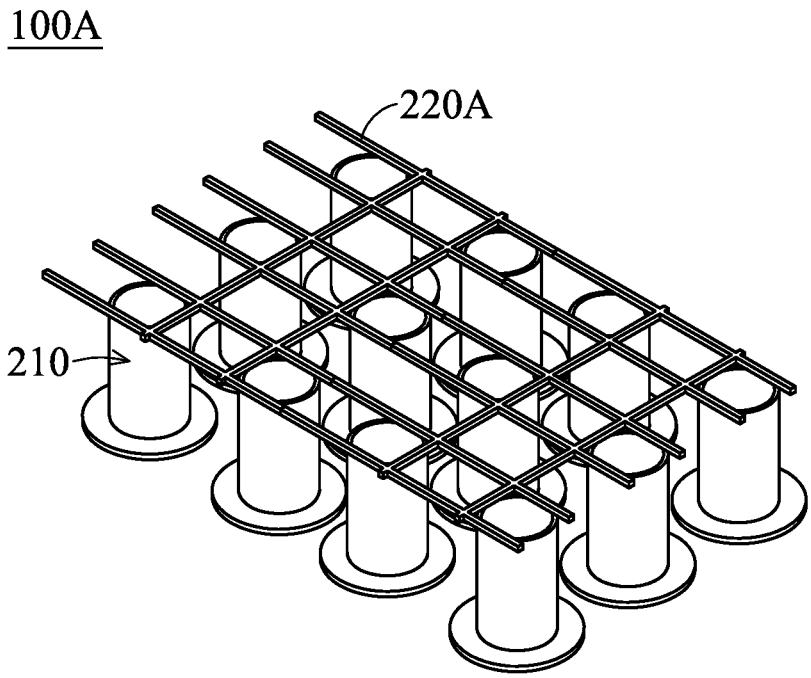
FIG. 6 illustrates a perspective view of another waste collection apparatus with a different number of floating units, in accordance with some embodiments.

It should be noted that, the arrangements and the number of floating units 210 are not limited thereto. Please refer to FIG. 6 to see another waste collection apparatus 100A with a different number of floating units 210. Since the number of floating units 210 is different, a frame 220A used for connecting the floating units 210 to each other is also structurally different. The arrangement and number of floating units 210 may be adjusted based on actual need. For example, the floating units 210 of the waste collection apparatus 100 and the floating units 210 of the waste collection apparatus 100A are both arranged symmetrically, but in some other embodiments, the floating units 210 may be arranged asymmetrically. For example, if there is need for larger space for collecting waste, some of the floating units 210 may be omitted.

Figure 7A:
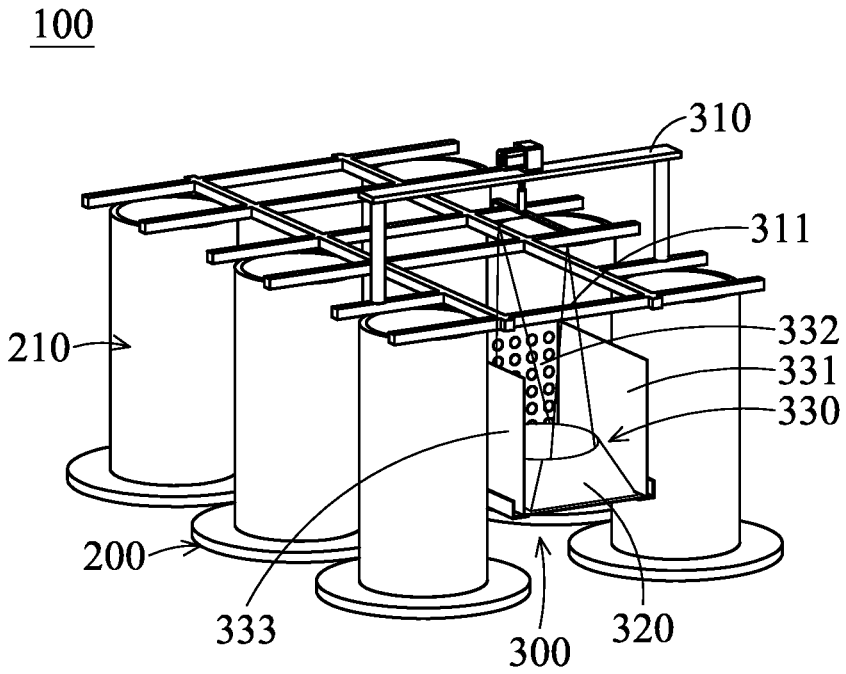
FIG. 7A and FIG. 7B illustrate perspective views of the waste collection apparatus, in which a waste bag is at different positions, in accordance with some embodiments.
Figure 7B:
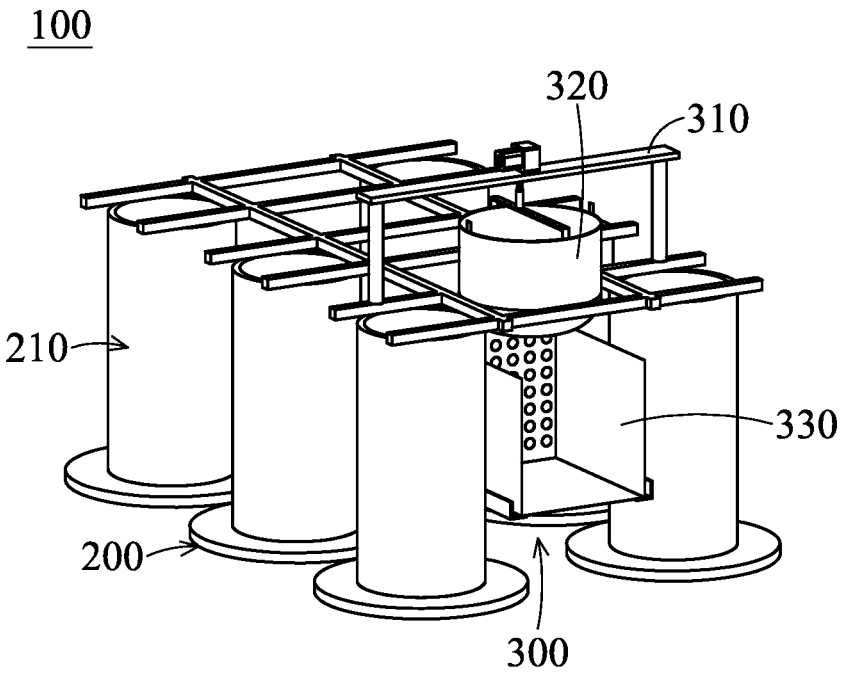

Next, please refer to FIG. 7A and FIG. 7B. In some embodiments, the waste collection device 300 includes a suspension unit 310, a waste bag 320 coupled to the waste suspension unit 310, and a waste container 330 disposed between some of the floating units 210. The suspension unit 310 is disposed above the frame 200. The suspension unit 310 may include a supporting stand, a motor, and a suspension assembly connected to the rotary axis of the motor and the waste bag 320. The waste bag 320 may be moved up and down by the suspension unit 310. In detail, due to the motion of the motor (e.g. rotation), the suspension assembly may be driven to lift the waste bag 320. In some embodiments, the waste bag 320 is moved up and down through at least one of the hollow portions 221 of the frame 220. In detail, in FIG. 7A, the waste bag 320 is located in the waste container 330, and in FIG. 7B, the waste bag 320 is removed from the waste container 330.

The waste bag 320 may be made of a flexible material. When the waste bag 320 is located in the waste container 330, the waste bag 320 may be compressed and kept in place. In some embodiments, a material with a density higher than water may be arranged on the opening of the waste bag 320, so the waste bag 320 may be flattened out at the bottom of the waste container 330. In some embodiments, the waste container 330 includes a plurality of sidewalls 331, 332, and 333, and the sidewall 332 includes a plurality of holes. Therefore, water can still flow through the sidewall 332 via the holes and bring waste to flow into the waste container 330 when waste is accumulated in the waste container 330.

In some embodiments, the waste collection apparatus 100 may include a sensing device (not shown) for sensing the amount of collected waste and/or a control device (not shown) coupled to the sensing device. In some embodiments, if the sensing device detects the amount of collected waste in the waste bag 320 is almost full, a signal may be sent to the control device, and an operator may decide whether or not to remove the waste bag 320 from the waste container 330. In some embodiments, if the sensing device detects the amount of collected waste in the waste bag 320 is almost full, a signal may be sent to the suspension unit 310, and the suspension unit 310 can remove the waste bag 320 from the waste container 330 directly. In some embodiments, the signal may be message shown on the control device. In some embodiments, the sensing device may be a camera, and images about the amount of collected waste in the waste bag 320 is sent to the control device, and an operator may decide whether or not to remove the waste bag 320 from the waste container 330 according to the display of the control device. In embodiments in which the waste bag 320 is provided, the waste bag 320 may be tied after the waste bag 320 is removed from the waste container 330, so the waste does not spill out. In addition, the waste bag 320 may be transported to a recycling plant.

Figure 8A:
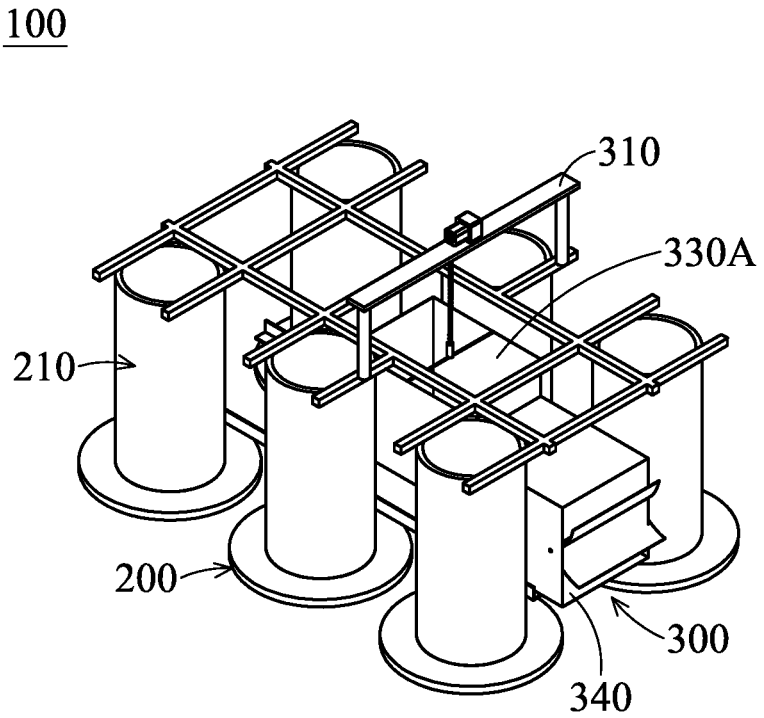
FIG. 8A and FIG. 8B illustrate perspective views of the waste collection apparatus, in which a waste container is at different positions, in accordance with some embodiments.
Figure 8B:
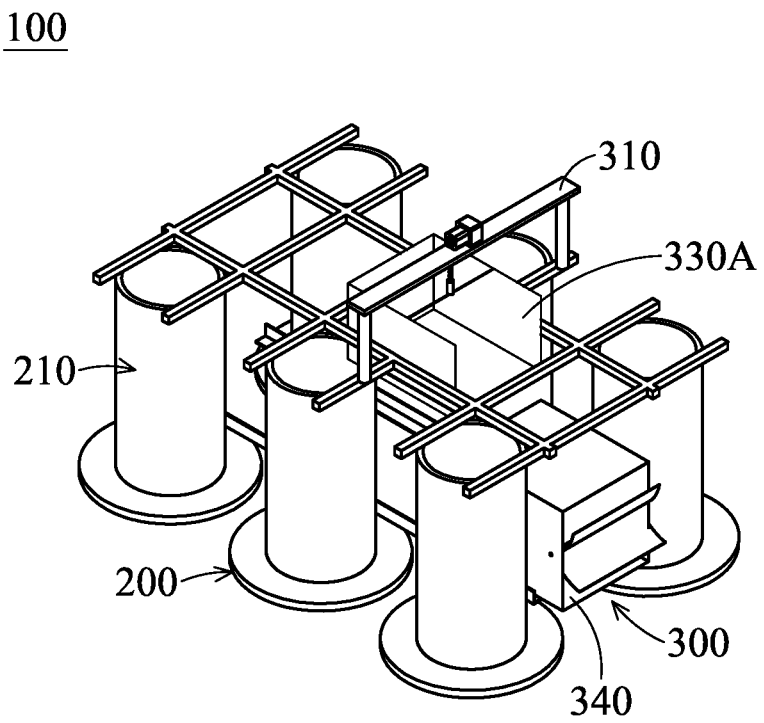

Next, please refer to FIG. 8A and FIG. 8B. In some embodiments, the waste collection device 300 includes the suspension unit 310, a waste container 330A coupled to the waste suspension unit 310, and an entrance unit 340. In detail, in FIG. 8A, the waste container 330A corresponds to the entrance unit 340, and in FIG. 8B, the waste container 330A is moved up and no longer correspond to the entrance unit 340. The waste container 330A may be moved up and down by the suspension unit 310. The entrance unit 340 may include a plurality of walls, and flow paths are formed therebetween. In some embodiments, a plurality of blades may be disposed in the flow paths. The waste container 330A is placed at the ends of the flow paths to collect waste passing through the flow paths. Due to rotation of the blades, more water flow is generated to allow more waste to flow into the waste collection apparatus 100. The waste container 330A may be similar to the waste container 330. In some embodiments, there are no holes formed on at least one of the sidewalls of the waste container 330, 330A. It should be noted that, the waste container 330 can also be used in the embodiments illustrated in FIG. 8A and FIG. 8B. Similarly, the waste collection apparatus 100 may include a sensing device (not shown) for sensing the amount of collected waste. If the sensing device detects the amount of collected waste in the waste container 330A is almost full, a signal may be sent to the suspension unit 310 to move up the waste container 330A.

Figure 9:
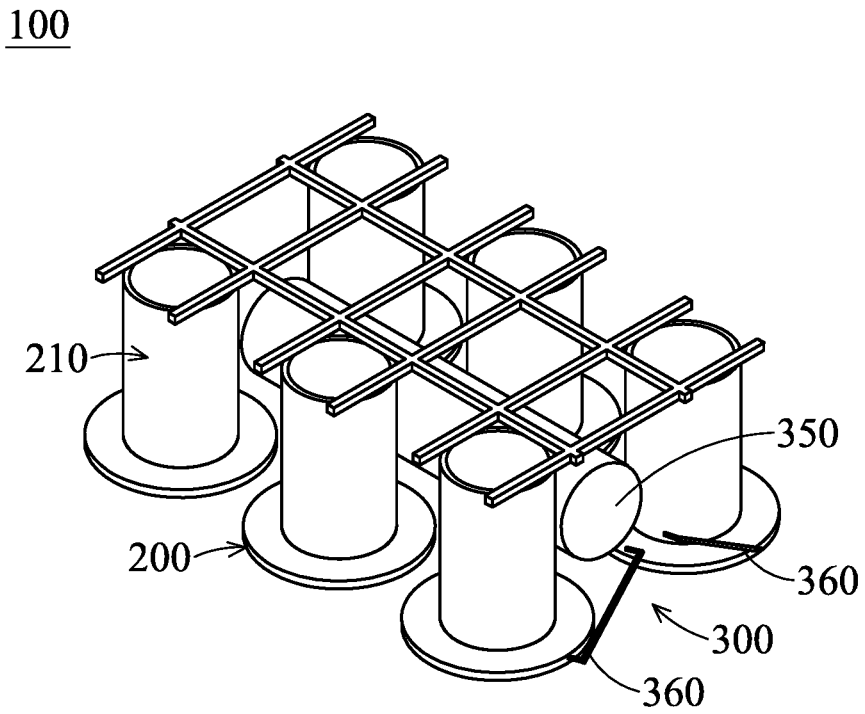
FIG. 9, FIG. 10, and FIG. 11 illustrate perspective views of the waste collection apparatus with different numbers and configurations of bin(s) and fluid ejection element(s), in accordance with some embodiments.
Figure 10:
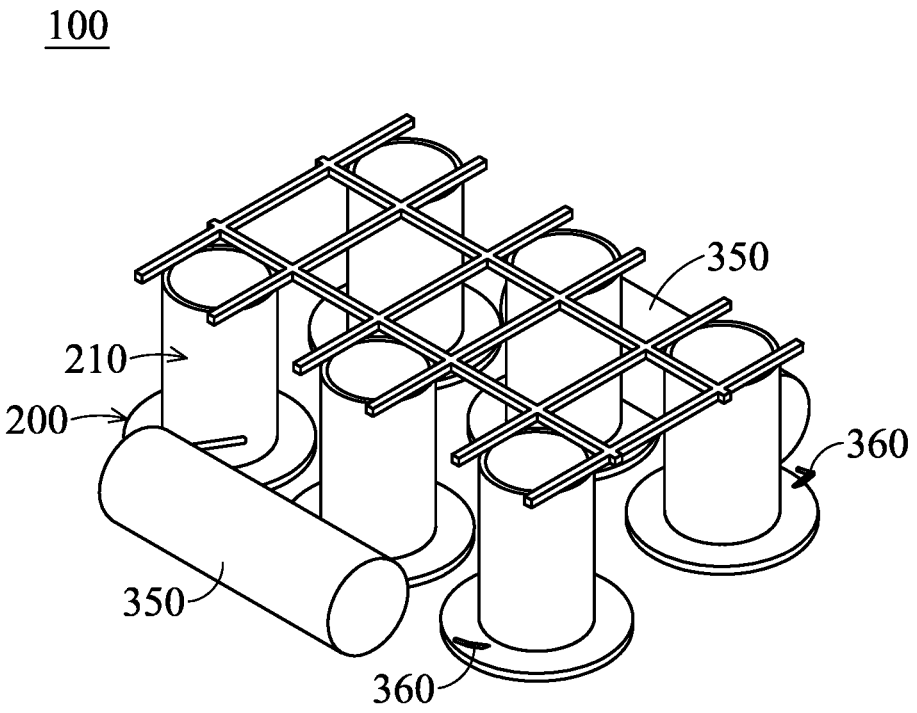
Figure 11:
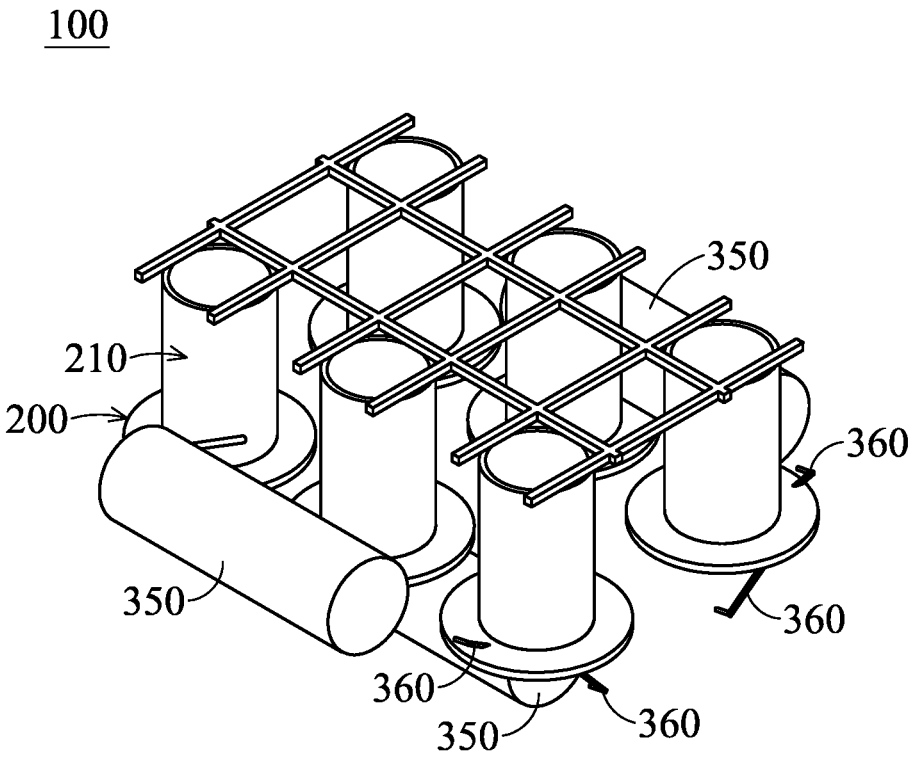

Please refer to FIG. 9 to FIG. 11. In some embodiments, the waste collection device 300 may include a bin 350 and a fluid ejection element 360. The bin 350 may be disposed close to the floating units 210. For example, the bin 350 may be disposed between the floating units 210. The fluid ejection element 360 may be coupled to the base 211, the pillar 212, or the frame 220.

The bin 350 may be used for collecting and accommodating waste, and thus enhance collection efficiency. In some embodiments, the interior of the bin 350 may be partitioned into several parts for sorting waste. For example, plastic, metal, and glass may be separated from each other by their differences in density. In some embodiments, to make it easier for waste to flow into the bin 350, the bin 350 may be tilted, with the water level slightly above the lower edge of the front side of the bin 350. In some embodiments, the degree of tilt of the bin 350 may be adjusted according to the water level.

In some embodiments, the fluid ejection element 360 may be a pipe. The flow out of the fluid ejection element 360 flows toward the space for collecting waste (e.g. the space inside the bin 350) along a predetermined path. Due to Bernoulli's principle, the flow out of the fluid ejection element 360 can create a decrease in pressure in the ambient water, so the ambient water near the predetermined path also flows into the waste collection apparatus 100 along the predetermined path. Therefore, the amount of water that flows into the waste collection apparatus 100 is increased, and thus the amount of waste that flows into the waste collection apparatus 100 is also increased. In some embodiments, the angle of the fluid ejection element 360 and the rate of the flow out of the fluid ejection element 360 may be adjusted to improve collection efficiency. For example, in embodiments in which a sensing device for sensing the amount of waste to be collected is provided, if the sensing device detects a large amount of waste approaching the waste collection apparatus 100, a signal may be sent to the fluid ejection element 360 to increase the flow rate of the flow out of the fluid ejection element 360. If the sensing device detects only a small amount of waste approaching the waste collection apparatus 100, a signal may be sent to the fluid ejection element 360 to decrease the flow rate of the flow out of the fluid ejection element 360 or to turn off the fluid ejection element 360 for saving energy.

The number of bins 350 and the number of fluid ejection elements 360 may be changed. As shown in FIG. 9 to FIG. 11, one or more bins 350 and one or more fluid ejection elements 360 may be provided close to the floating units 210, such as on the opposite sides of the floating units 210 and under the floating units 210. For example, one or more bins 350 may be disposed on one side of the pillar 212 or below the base 211. The bin 350 located at different positions may be used to collect waste at different depths, and the type of waste may be different at different depths. For example, the bin 350 that is disposed on one side of the pillar 212 may be used to collect waste that is close to the water level, such as bottles. The bin 350 that is disposed below the base 211 may be used to collect waste that is under the water line, such as fishing nets. The waste collection apparatus 100 may include a suction pump (not shown). The suction pump may be disposed above the frame 220, the base 211, or the pillar 212. The suction pump may lift external water by suction pipes and supplies the external water to the fluid ejection elements 360 through supply pipes.

Figure 12:
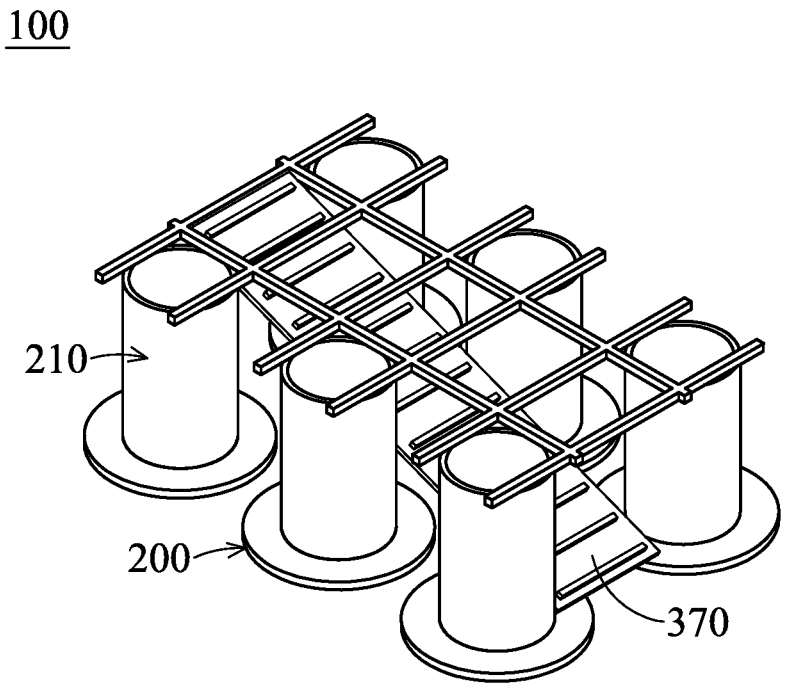
FIG. 12 illustrates a perspective view of the waste collection apparatus with a conveyor belt, in accordance with some embodiments.

Please refer to FIG. 12. In some embodiments, the waste collection device 300 may include a conveyor belt 370. The conveyor belt 370 may be placed in the space for collecting waste (e.g. between the floating units 210) and to transport waste. In some embodiments, the conveyor belt 370 is coupled to the frame 220, and the frame 220 may temporarily store the collected waste. In some embodiments, a waste storage unit (not shown) may be coupled to the conveyor belt 370 to temporarily store the collected waste.

Figure 13:
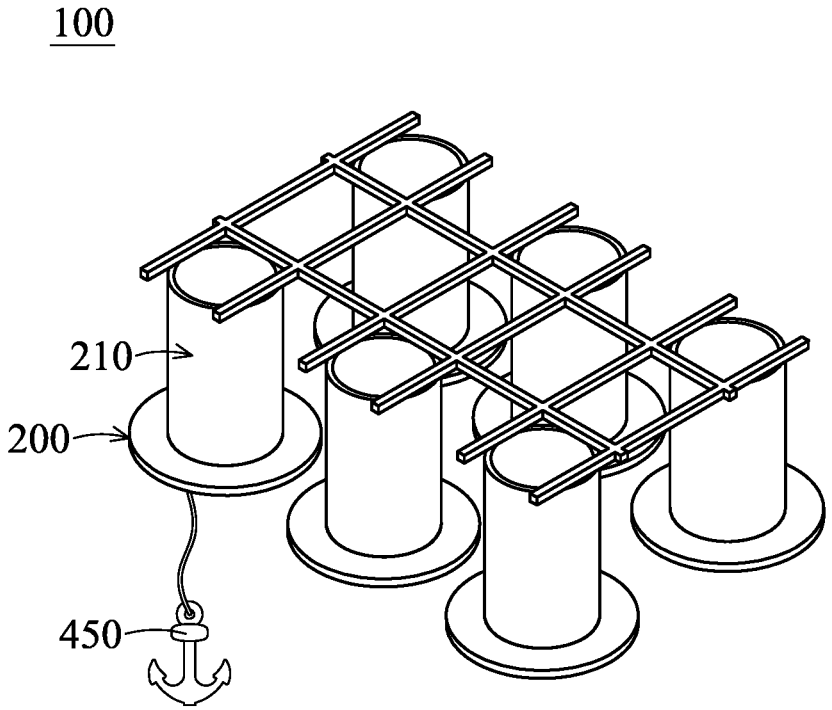
FIG. 13 and FIG. 14 illustrate perspective views of the waste collection apparatus with an anchor, in accordance with some embodiments.
Figure 14:
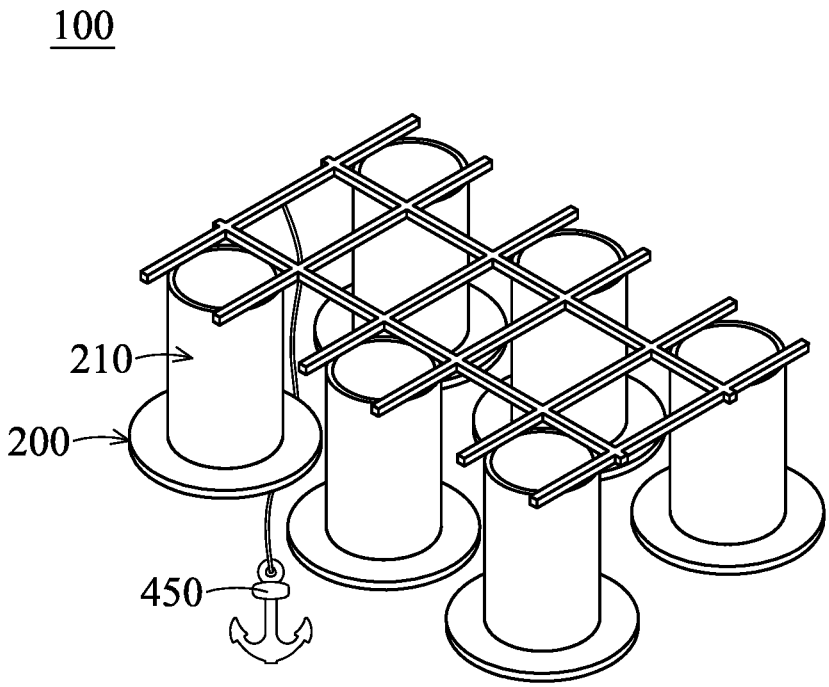

Please refer to FIG. 13 and FIG. 14. To prevent the waste collection apparatus 100 from moving away, in some embodiments, the waste collection apparatus 100 may include an anchor 450. The anchor 450 may be attached to the frame 220 or at least one of the floating units 210.

Figure 15:
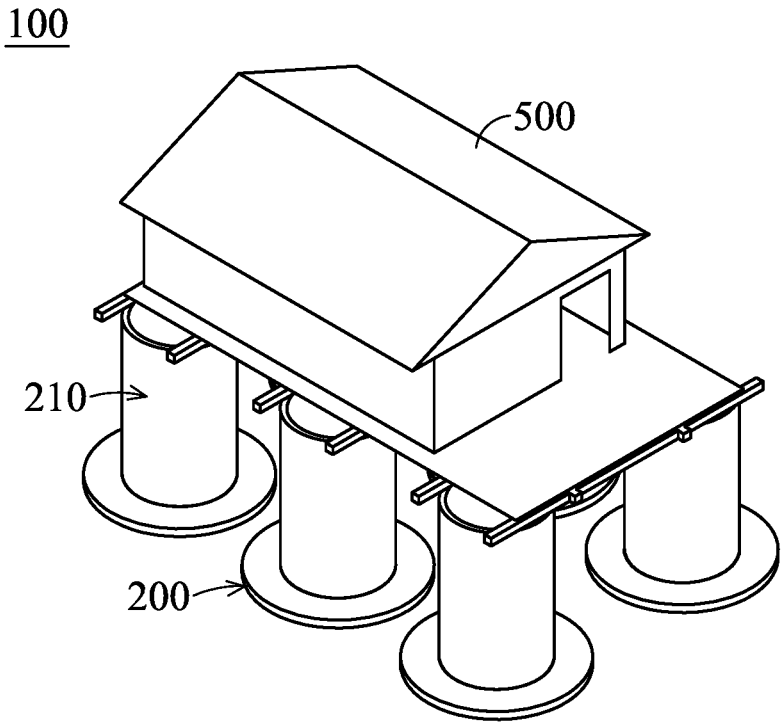
FIG. 15 illustrates a perspective view of the waste collection apparatus with a construction, in accordance with some embodiments.

Please refer to FIG. 15. In some embodiments, the construction 500 may be built on the floating units 210 and the frame 220. The frame 220 may distribute the weight of the construction 500. The construction 500 may be a building, a recreational facility, a gym, etc. The construction 500 may include solar panels. In embodiments in which solar panels are provided, the energy generated may be supplied to different devices or elements of the waste collection apparatus 100, for example, to operate the fluid ejection element 360 or the conveyor belt 370.

To ensure that the center of gravity of the waste collection apparatus 100 is relatively low to ensure that the waste collection apparatus 100 is stable, the density of the base 211 is greater than the density of the construction 500. For example, the construction 500 is made of expanded polystyrene (EPS) or expanded polypropylene (EPP), and the pillar 212 and the base 211 are made of concrete. In some embodiments, the number of the floating units 210 is determined by the dimensions and weight of the construction 500. For example, if the construction 500 is relatively big, the number of floating units 210 may be large.

In some embodiments, external water may be utilized, for example, provided to the waste collection apparatus 100. For example, the construction 500 may include a toilet (not shown), and external water may be used for flushing the toilet. For example, the construction 500 may include a cooling system (not shown), and the waste collection apparatus 100 may include a suction pump (not shown). The suction pump may lift external water by suction and supplies the external water to the cooling system to lower temperature of the construction 500. In some embodiments, the suction pump that provides external water to the fluid ejection element 360 may also provide external water to the construction 500 on the waste collection apparatus 100 at the same time.

It should be noted that the features of various embodiments described above may be arbitrarily combined with each other. For example, the combination of the entrance unit 340 and the conveyor belt 370 may be an effective way to increase the amount of waste that flows into the waste collection apparatus 100.

Figure 16:
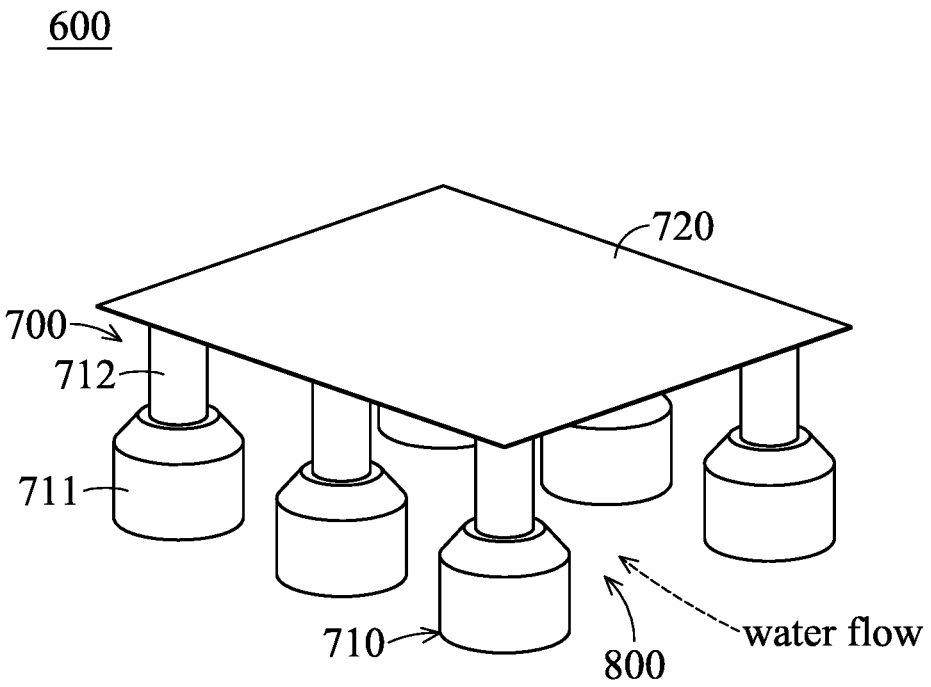
FIG. 16 and FIG. 17 illustrate perspective views of another type of waste collection apparatus, in accordance with some embodiments.
Figure 17:
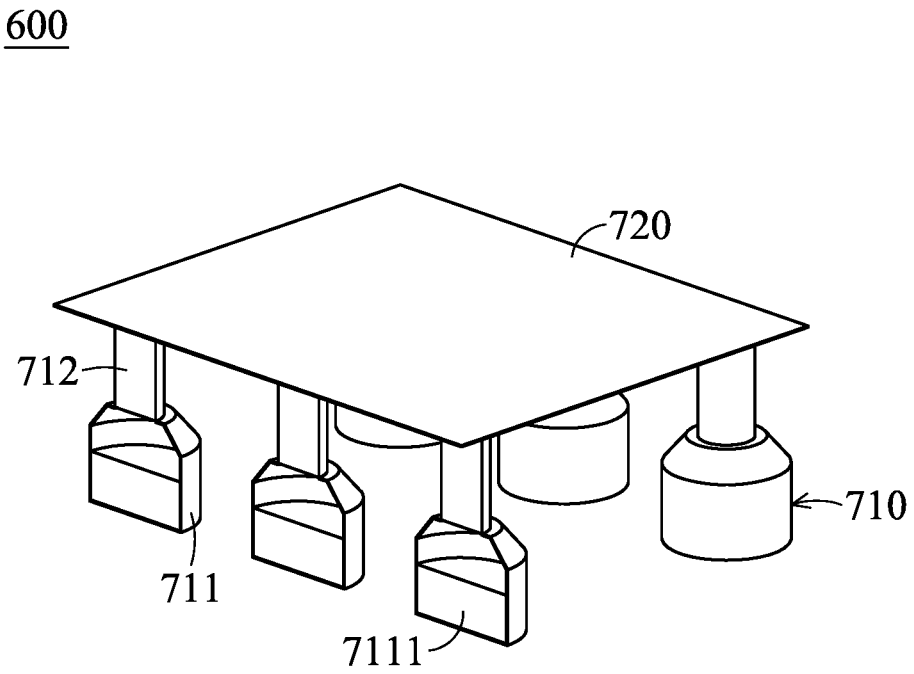

Please refer to FIG. 16 and FIG. 17. Another type of waste collection apparatus 600 is provided. The waste collection apparatus 600 includes a floating device 700 and a waste collection device 800 coupled to the floating device 700. The floating device 700 includes a plurality of floating units 710. Each of the floating units 710 includes a base 711 and a pillar 712 connected to the base 711. The floating device 700 may also include a platform 720 connected to the pillar 712. In some embodiments, the waste collection device 800 represents the space formed between the floating units 710. The space may be used for collecting and accommodating waste. In some embodiments, the waste collection device 800 includes elements close to the floating units 710, and the elements may be specifically used for collecting and accommodating waste. In some embodiments, the pillar 712 and the base 711 are hollow, and a stabilizing element 7111 is disposed inside the base 711. In some embodiments, the base 711, the pillar 712, and the platform 720 are made of fiber reinforced plastic (FRP), and the stabilizing element 7111 is made of concrete, so the center of gravity of the waste collection apparatus 600 is relatively low to ensure that the waste collection apparatus 600 is stable.

Figure 18:
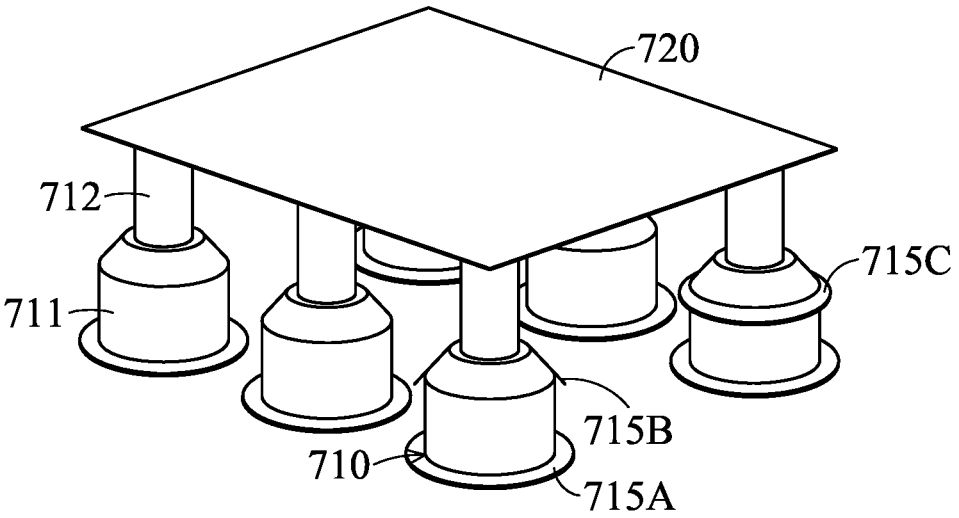
FIG. 18 illustrates a perspective view of the waste collection apparatus with a balance element, in accordance with some embodiments.

Next, please refer to FIG. 18. The base 711 may include a balance element 715A, 715B, or 715C. The balance element 715A, 715B, or 715C helps to keep the floating units 710 balanced in the water. The balance element 715A protrudes from the base 711. The balance element 715B is a fin, protruding from part of the base 711. The balance element 715C surrounds around part of the base 711. In some embodiments, the balance element 715A, 715B, or 715C may be referred to as "a bilge keel." The arrangement and number of balance element 715A, 715B, or 715C may be adjusted based on actual need, such as needed damping force of the floating units 710.

Figure 19:
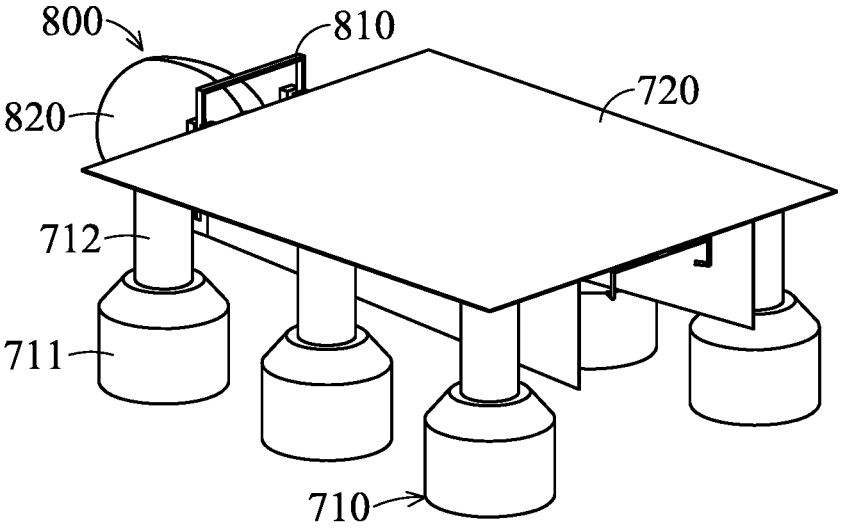
FIG. 19 illustrates a perspective view of the waste collection apparatus with a waste bag, guidance elements, and fluid ejection elements, in accordance with some embodiments.
Figure 20A:
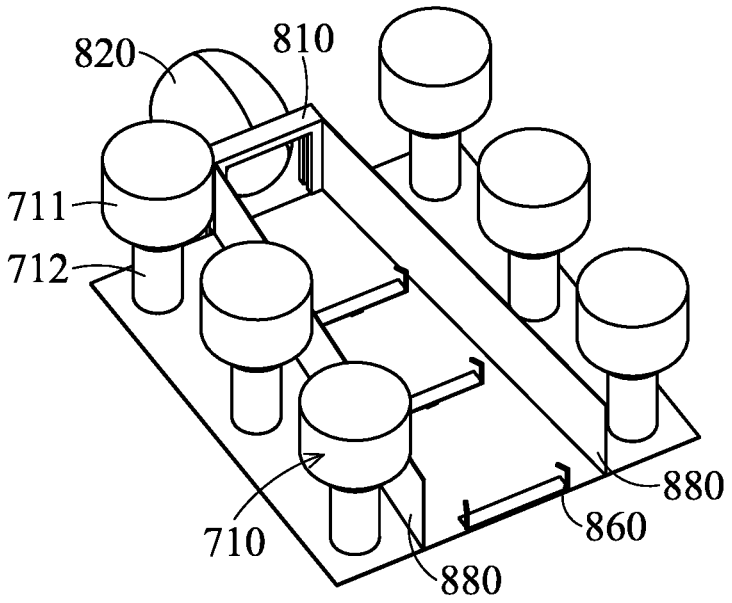
FIG. 20A and FIG. 20B illustrate bottom perspective views of the waste collection apparatus with different configurations of fluid ejection elements, in accordance with some embodiments.
Figure 20B:
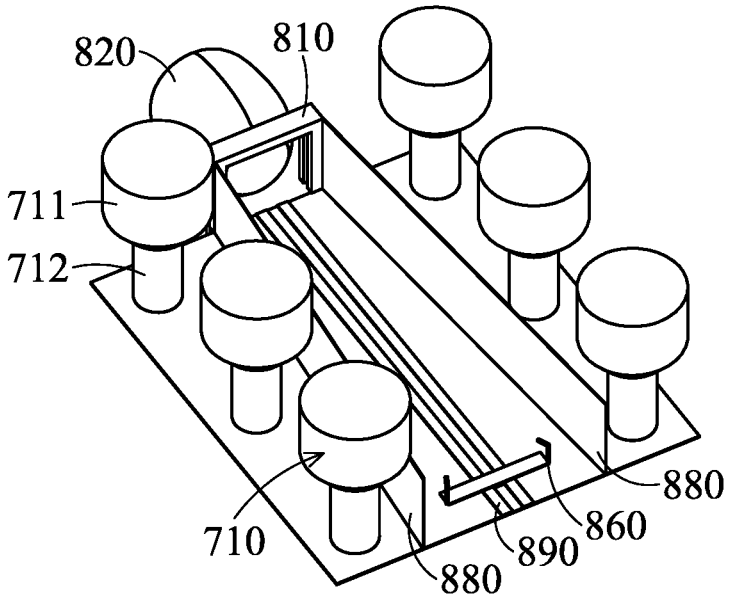

Then, please refer to FIG. 19, FIG. 20A, and FIG. 20B. In this embodiment, the waste collection device 800 includes a mounting unit 810 and a waste bag 820. The waste bag 820 is coupled to the mounting unit 810. If the amount of collected waste in the waste bag 820 is almost full, an operator may lift (e.g. by operating a boat including a crane device) the waste bag 820 relative to the mounting unit 810, so the waste bag 820 may be removed from the mounting unit 810. In addition, the collection device 800 may also include two guidance elements 880. The distance between the guidance elements 880 gradually decreases along the flow path of water, thereby guiding the waste to the waste bag 820. In some embodiments, each of the guidance elements 880 is wall-like.

Furthermore, to enhance collection efficiency, the collection device 800 may also include one or more fluid ejection elements 860. The fluid ejection elements 860 are located at the bottom surface of the platform 720. The waste collection apparatus 600 may include a suction pump (not shown). The suction pump may be disposed above the platform 720. The suction pump may lift external water by suction pipes and supply the external water to the fluid ejection elements 860 through supply pipes. In FIG. 20A, there are several sets of fluid ejection elements 860 along the flow path of water. In FIG. 20B, there is only one set of fluid ejection elements 860, but the fluid ejection elements 860 are disposed on a rail 890, so the fluid ejection elements 860 may move smoothly. For example, if a sensing device detects a large amount of waste, a signal may be sent to the fluid ejection elements 860, and the fluid ejection elements 860 may move to the place where the large amount of waste is accumulated.

Figure 21:
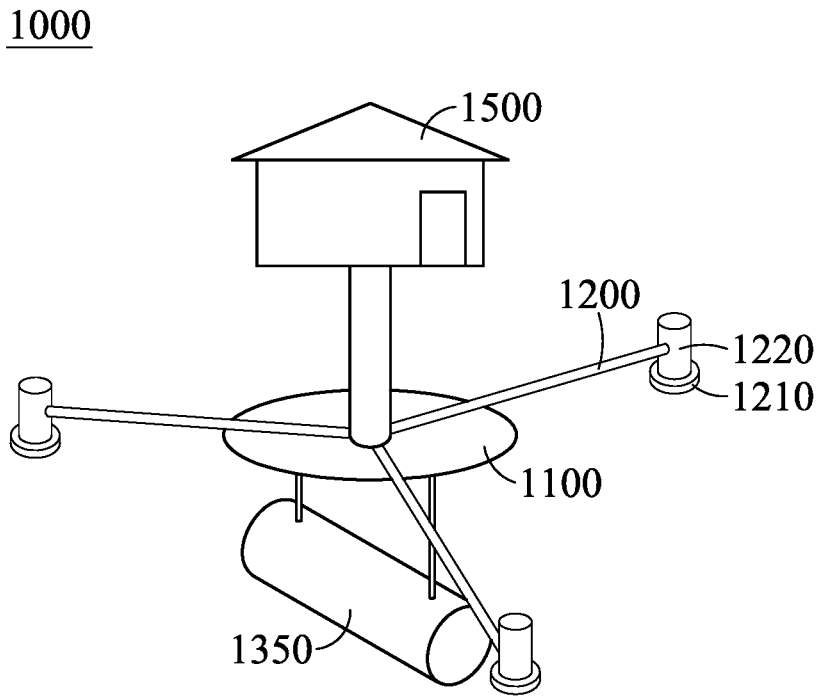
FIG. 21 to FIG. 23 illustrate perspective views of other types of waste collection apparatus, in accordance with some embodiments.

Next, please refer to FIG. 21. Another type of waste collection apparatus 1000 is provided. The waste collection apparatus 1000 includes a floating platform 1100 and a plurality of branching units 1200 connected to the floating platform 1100. The waste collection apparatus 1000 may also include a bin 1350 disposed below the floating platform 1100. A construction 1500 is built on the floating platform 1100. Each branching units 1200 includes a bottom plate 1210 and a column 1220 connected to the bottom plate 1210. The branching units 1200 may help the waste collection apparatus 1000 be more stable and may prevent the waste collection apparatus 1000 from capsizing. For the waste collection apparatus 1000, the water level is designed to be within a certain range of the height of the column 1220. To make sure the water level is within a certain range of the height of the column 1220, the density of the bottom plate 1210 is greater than the density of the column 1220, so the center of gravity of the waste collection apparatus 1000 is relatively low to ensure that the waste collection apparatus 1000 is stable.

Figure 22:
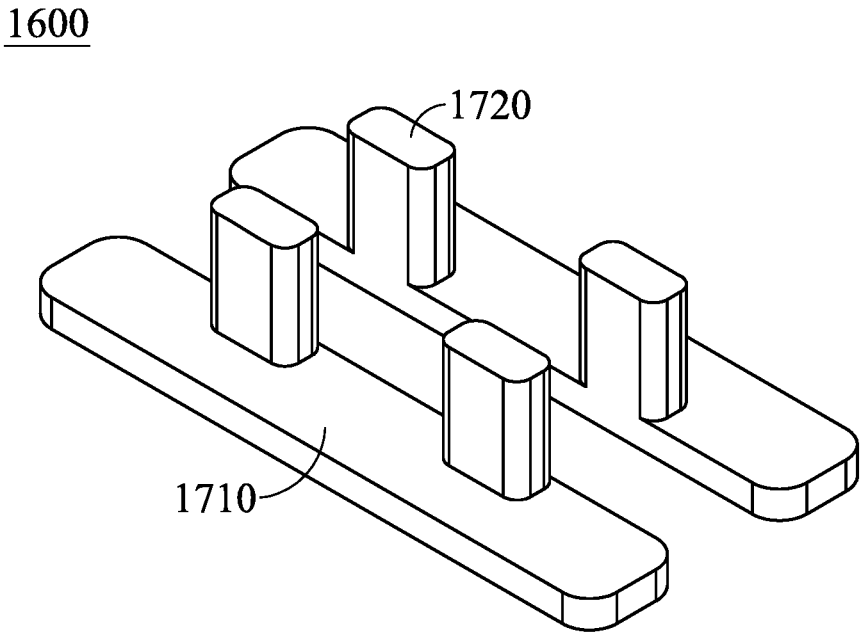

Next, please refer to FIG. 22. Another type of waste collection apparatus 1600 is provided. The waste collection apparatus 1600 includes two bases 1710 and a plurality of pillars 1720 connected to the bases 1710. The entirety of each of the bases 1710 and part of the pillars 1720 may be under the water level. The space between the bases 1710 may be used for collecting and accommodating waste. In some embodiments, the density of the bases 1710 is greater than the density of the pillars 1720. In some embodiments, there may be cavities inside the bases 1710 or the pillars 1720. In some embodiments, there are air-filled balls inside the bases 1710 or the pillars. The balls may be made of plastic, but the material of the balls is not limited thereto.

Figure 23:
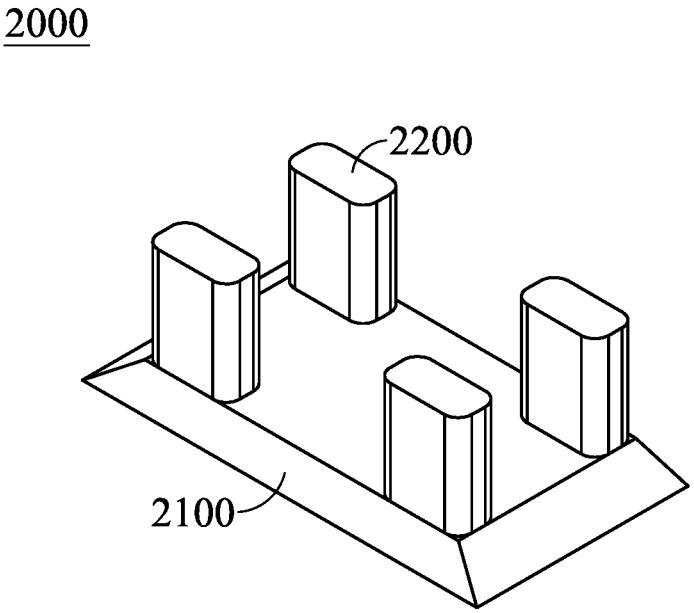

Next, please refer to FIG. 23. Another type of waste collection apparatus 2000 is provided. The waste collection apparatus 2000 includes a base 2100 and a plurality of pillars 2200. In this embodiment, the base 2100 is platform-like.

Based on the present disclosure, a waste collection apparatus for collecting waste in water is provided. The waste collection apparatus includes a floating device including a plurality of floating units. Each of the floating units may be manufactured by the same processes, so the stability of the waste collection apparatus may be guaranteed through the standardization of manufacture of the floating units. In addition, manufacture cost may be reduced due to the standardization. Each of the floating units includes a base and a pillar connected to the base. The density of the base is greater than the density of the pillar, so the center of gravity of the waste collection apparatus is relatively low to ensure that the waste collection apparatus is stable. Different devices or elements, such as a waste container, a suspension unit, a bin, a conveyor belt, and the like, may be further utilized for collecting and accommodating waste. Furthermore, a construction may be built on the floating units, so the waste collection apparatus may have wider application.

The foregoing outlines features of several embodiments, so that those skilled in the art may better understand the aspects of this disclosure. Those skilled in the art should appreciate that they may readily use this disclosure as a basis for designing or modifying other processes and structures for carrying out the same purposes and/or achieving the same advantages of the embodiments introduced herein. Those skilled in the art should also realize that such equivalent constructions do not depart from the spirit and scope of this disclosure, and that they may make various changes, substitutions, and alterations herein without departing from the spirit and scope of this disclosure. In addition, the scope of this disclosure is not limited to the specific embodiments described in the specification, and the combination of various claims and embodiments are within the scope of the disclosure.

What is claimed is:

1. A waste collection apparatus for collecting waste in water, comprising:

a floating device including a plurality of floating units; and a waste collection device coupled to the floating device, wherein each of the floating units includes a base and a pillar connected to the base, and a density of the base is greater than a density of the pillar, and wherein the waste collection device comprises a fluid ejection element, and flow out of the fluid ejection element flows toward a space in the water where waste is collected.

2. The waste collection apparatus as claimed in claim 1, wherein a center of gravity of each of the floating units is under a water level of the water.

3. The waste collection apparatus as claimed in claim 1, wherein the base and the pillar comprise steel, aluminum, steel reinforced concrete, reinforced concrete, fiber reinforced plastic, or a combination thereof.

4. The waste collection apparatus as claimed in claim 1, wherein the floating device further comprises a waterproof element disposed at a connection part where the pillar and the base are connected.

5. The waste collection apparatus as claimed in claim 1, wherein the pillar is hollow, the base is solid, and a diameter of the base is greater than a diameter of the pillar.

6. The waste collection apparatus as claimed in claim 5, wherein the floating device further comprises a counterweight disposed inside the pillar or on the base.

7. The waste collection apparatus as claimed in claim 5, wherein the floating device further comprises a bulk element disposed inside the pillar, and the bulk element includes expanded polystyrene (EPS) or expanded polypropylene (EPP).

8. The waste collection apparatus as claimed in claim 1, wherein the floating device further comprises a frame connecting the floating units to each other.

9. The waste collection apparatus as claimed in claim 8, wherein the frame is a grid structure.

10. The waste collection apparatus as claimed in claim 9, further comprising a power supply unit disposed in a hollow portion of the grid structure.

11. The waste collection apparatus as claimed in claim 8, wherein the frame comprises metal.

12. The waste collection apparatus as claimed in claim 8, wherein the floating device further comprises a plurality of fastening elements, and the frame is connected to the floating units via the fastening elements.

13. The waste collection apparatus as claimed in claim 8, wherein the frame is in contact with an upper surface of the pillar.

14. The waste collection apparatus as claimed in claim 13, wherein the floating device further comprises a reinforcement frame, and the reinforcement frame is in contact with an outer surface of the pillar.

15. The waste collection apparatus as claimed in claim 8, further comprising an anchor attached to the frame or at least one of the floating units.

16. The waste collection apparatus as claimed in claim 8, further comprising a construction built on the frame.

17. The waste collection apparatus as claimed in claim 16, wherein the density of the base is greater than a density of the construction.

18. The waste collection apparatus as claimed in claim 16, wherein a number of the plurality of floating units is determined by dimensions and weight of the construction.

19. The waste collection apparatus as claimed in claim 16, further comprising a suction pump, wherein a cooling system is provided on the construction, the suction pump lifts external water by suction and supplies the external water to the cooling system to lower temperature of the construction.

20. The waste collection apparatus as claimed in claim 1, wherein the fluid ejection element is disposed on a rail such that the fluid ejection element is movable.

21. The waste collection apparatus as claimed in claim 1, wherein the fluid ejection element is a pipe.

22. The waste collection apparatus as claimed in claim 1, further comprising a suction pump coupled to the floating device, wherein the suction pump lifts external water by suction and supplies the external water to the fluid ejection element.

23. The waste collection apparatus as claimed in claim 1, further comprising a sensing device for sensing an amount of collected waste.

24. A waste collection apparatus, comprising:

a floating platform;

a plurality of branching units connected to the floating platform and laterally extending beyond the floating platform; and a waste collection device disposed below the floating platform, wherein each of the branching units comprises a column and a bottom plate connected to the column, and a density of the bottom plate is greater than a density of the column.

* * * * *